United States Patent [19]

Raczynski

[11] 4,425,081

[45] Jan. 10, 1984

[54] CENTRIFUGAL PUMP WITH DISMOUNTABLE DIFFUSER

[75] Inventor: Wladyslaw Raczynski, Margency, France

[73] Assignee: Framatome, Courbevoie, France

[21] Appl. No.: 272,160

[22] Filed: Jun. 10, 1981

[30] Foreign Application Priority Data

Jun. 20, 1980 [FR] France ..... 80 13753

[51] Int. Cl.[3] ..... F03B 3/18

[52] U.S. Cl. ..... 415/211; 415/190; 29/156.8 CF

[58] Field of Search ..... 415/189, 190, 210, 211, 415/DIG. 3, DIG. 5; 416/191; 29/156.8, 464

[56] References Cited

U.S. PATENT DOCUMENTS 3,024,968 3/1962 Payne et al. ..... 415/190

3,953,147 4/1976 Aspinwall ..... 415/211

*Primary Examiner*—Harvey C. Hornsby

*Assistant Examiner*—Brian J. Bowman

*Attorney, Agent, or Firm*—Pollock, Vande Sande & Priddy

[57] ABSTRACT

A diffuser having at least three parts separable and couplable along coupling surfaces passing through the whole of its body between its inner and outer surfaces and between its coupling end with the suction pipe and its opposite end. Each of the parts of the diffuser is machined along an annular groove portion with a trapezoidal cross-section and includes an annular projection. The volute comprises an annular groove for the engagement of the projections. A centering part including an annular portion with a trapezoidal cross-section is removably fixed to the volute and is engaged in the groove formed by the groove portions. The invention is particularly applicable to primary pumps of pressurized water nuclear reactors.

6 Claims, 5 Drawing Figures

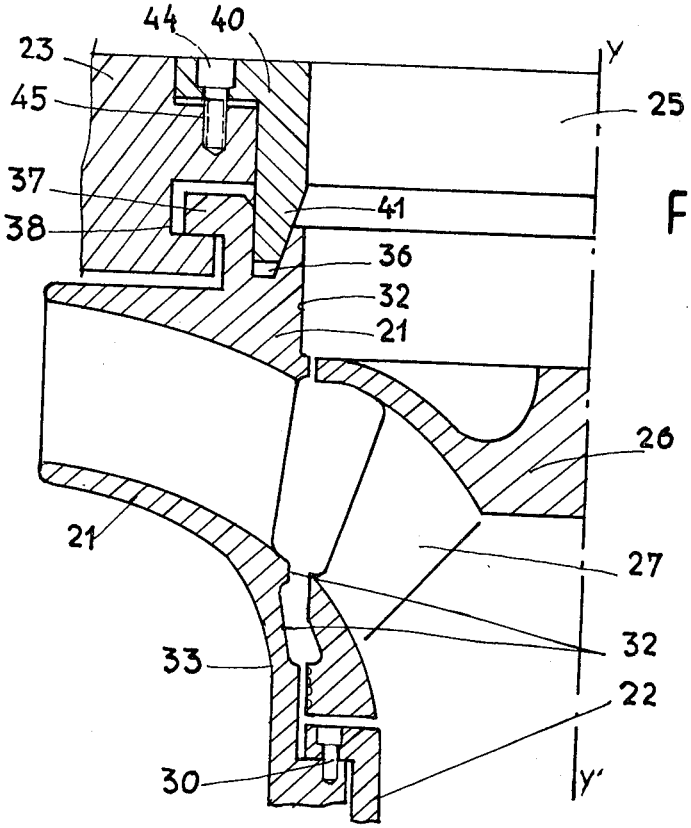
Fig 3
Fig 4
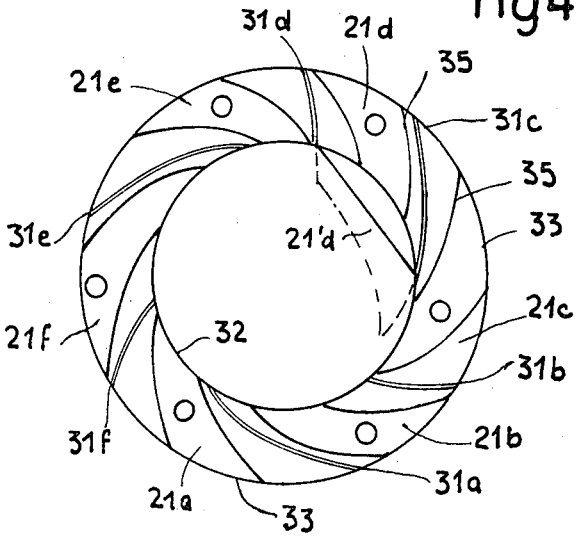

CENTRIFUGAL PUMP WITH DISMOUNTABLE DIFFUSER

FIELD OF THE INVENTION

The invention relates to a centrifugal pump with a dismountable diffuser for circulating a fluid such as the cooling fluid of a nuclear reactor.

BACKGROUND OF THE INVENTION

In nuclear reactors such as pressurized water nuclear reactors, the fluid for cooling the fuel assemblies constituting the core of the reactor is circulated in the cooling circuit or primary circuit by motor-pumps comprising a helicocentrifugal pump and a drive motor for this pump.

Such a centrifugal pump includes a volute constituted by an enclosure generally welded to the pipes of the primary circuit, in which openings are formed for the entry and exit of the cooling fluid in the pump.

A dismountable suction pipe extends the opening for entry into the side of the volute and a rotor mounted on a shaft connected to the drive motor is placed inside the volute, in extension of the suction pipe for the circulation of the cooling fluid. This rotor is constituted by an impeller wheel which is itself surrounded by a fixed diffuser bearing guide fins for the fluid and fastened at one of its ends to the suction pipe. This diffuser is generally connected rigidly and permanently with the volute either directly or only through the suction pipe.

An opening is provided in the volute to permit the passage of the rotor at the time of assembling the pump, this opening being then closed by a fluid-tight passage enabling the traversal of the shaft of the rotor between the inside of the volute and the drive latter. However, this solution leads to an unfavorable hydraulic shape and requires a relatively large diameter of the opening of the volute.

If a radial shape of the diffuser more favorable from the hydraulic point of view is adopted, an upper axial opening of the volute must be provided which is still larger, and this presents drawbacks which have been mentioned above.

SUMMARY OF THE INVENTION

It is therefore an object of the invention to provide a centrifugal pump with a dismountable diffuser for circulating a fluid, comprising a volute constituted by an enclosure having openings for the entry and exit of the fluid, a dismountable suction pipe fixed to the volute at the level of the entry aperture for the fluid and directed to the inside of the latter, a rotor placed inside the volute fixed to a shaft passing through an aperture provided in the wall of the volute and permitting the passage of the rotor, for coupling to a drive motor as well as a diffuser of annular shape having for axis of symmetry of revolution the axis of rotation of the rotor, arranged around the rotor inside the volute and fixed to the suction pipe at one of its ends, the operations of examination and maintenance of the internal members of the pump, in particular the inner surface of the volute and the diffuser, being possible by means of suitable checking equipment introduced through the opening for the passage of the rotor.

Accordingly, the diffuser according to the invention comprises at least three parts separable and couplable along coupling surfaces traversing the whole of the body of the diffuser between its inner surface positioned towards the rotor and its outer surface directed towards the inner surface of the volute and between its motor fixed to the volute above the passage opening of the rotor.

The diffuser positioned around the rotor enables the guidance of the cooling fluid impelled by the blade wheel of the rotor, inside the volute before its exit through the exit aperture.

Such pumps, which have a very high delivery rate, above 20,000 m3/hour, which effects the circulation of a fluid at high pressure and at high temperature, are subject to particularly severe operating conditions.

On the other hand, very great reliability of these devices is required, so that checking and maintenance operations are necessary between two periods of continuous use of the pump.

The motor-pump unit must thus be designed as a removable unit enabling examination of the inner surface of the volute and of the connecting welds.

In other respects, the diameter of the upper axial opening of the volute above which the drive motor of the pump is placed must be as small as possible in order to limit the forces exerted in operation, for example on the assembly flanges between the pump and the motor.

These two requirements involving accessibility to the inner parts of the pump and the size of the axial opening of the volute are contradictory, since the examination of the inner surface of the volute and of the welds assumes dismounting and extraction of the diffuser through the axial opening of the volute.

It has therefore been proposed to use a diffuser possessing an axial shape facilitating examination and maintenance of the volute from the upper axial opening of the coupling end with the suction pipe provided with dismountable connecting means and its opposite end, each of these parts of the diffuser being machined along an annular groove portion with a trapezoidal cross-section at its end opposite the end coupling with the suction pipe and including a projection forming a ring portion, while the volute includes an annular groove for the engagement of the annular projections of each of the parts of the diffuser, and a centering part including an annular part with a trapezoidal section is fixed removably to the volute for its engagement in the annular groove with trapezoidal section constituted by the groove portions of the parts of the diffuser, when they are juxtaposed.

In order that the invention may be more fully understood, there will now be described by way of non-limiting examples, with reference to the accompanying figures, two embodiments of a centrifugal pump according to the invention, this pump being of the type used in the primary circuit of pressurized water nuclear reactors.

BRIEF DESCRIPTION OF THE DRAWINGS

In the drawings:

FIG. 3 shows a partial view in section through a vertical plane of symmetry of an embodiment of a centrifugal pump according to the invention.

FIG. 4 is a diagrammatic view from above of the lower part of the diffuser of the pump shown in FIG. 3.

DETAILED DESCRIPTION

Figure 1:
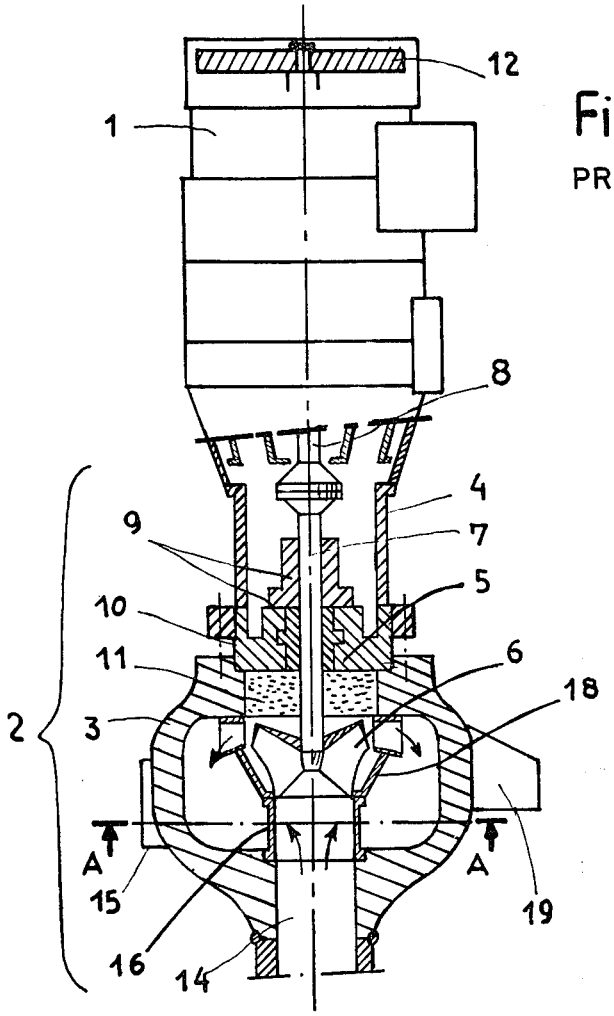
Fig 1 PRIOR ART
FIG. 1 shows a view in elevation with partial section through a plane of symmetry, of a centrifugal pump of the primary circuit of a pressurized water nuclear reactor, according to the prior art.
Figure 2:
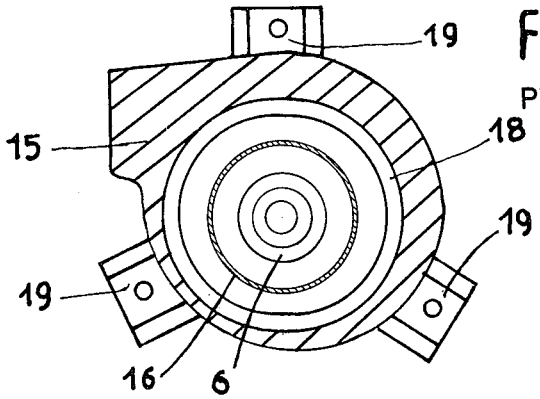
Fig 2 PRIOR ART
FIG. 2 shows a view along the line A—A of FIG. 1.

FIGS. 1 and 2 show a pump of the type presently used in the primary circuits of pressurized water nuclear reactors comprising a motor unit 1 and a pump unit 2. The motor unit 1 is coupled to the volute 3 of the pump through a support 4 connected by screws to the upper part of the volute 3 at the level of the upper axial opening 5 of this volute. The rotor 6 of the pump is mounted on a shaft 7 connected to the output shaft 8 of the motor 1.

The opening 5 permits the passage of the rotor 6 constituted by a blade wheel on the assembly of the pump and the fluidtight passage of the shaft 7 by means of seals and bearings 9, when the mounting of the pump is terminated as shown in FIG. 1, the closing of the opening 5 being assured by a closure member 10.

A thermal barrier 11 permits the heat transfer between the volute and the upper part of the pump (bearing, sealing joints, etc.) to be limited.

A flywheel 12 is mounted fast to the upper part of the shaft of the motor at the top part of this motor.

The volute 3 is pierced by an entry aperture 14 and an exit aperture constituting a delivery pipe 15 for the pressurized water. The aperture 14 is extended by a suction pipe 16 into the inner part of the volute 3. The pipe 16 is fixed to the volute 3 and can be dismounted and extracted through the opening 5.

The diffuser 18 is connected at the exit of the suction pipe 16 to the inside of the volute. This fixed diffuser of annular shape completely surrounds the rotor 6 and effects the guidance of the water whose path in the pump is indicated by arrows.

Fastening lugs 19 connect the pump to its suspension system.

FIG. 3 shows a portion of the centrifugal pump according to the invention, including a volute 23 having an upper axial opening 25 through which it is possible to introduce the rotor 26 constituted by a blade wheel 27.

Referring at the same time to FIGS. 3 and 4, it is seen that the diffuser 21 of this pump, fixed at its bottom part to the suction pipe 22 through screws 30, is constituted by six parts 21*a*, 21*b*, 21*c*, 21*d*, 21*e*, 21*f* separated by cut-outs 31*a*, 31*b*, 31*c*, 31*d*, 31*e*, 31*f*.

The cut-outs 31 are formed along curved surfaces passing through the whole annular body of the diffuser 21 between its inner surface 32 directed towards the rotor 26 and its outer surface 33 directed towards the inner surface of the volute. These cut-outs 31 are formed over the entire height of the diffuser from its junction portion with the suction pipe 22 to its upper portion at the level of the upper axial opening 25 of the volute. In this way the six parts 21*a* to 21*f* of the diffuser are entirely separable from one another on dismounting the diffuser.

The cut-outs 31 are each formed between two successive blades 35 of the diffuser.

Certain of the parts of the diffuser, like the part 21*d*, are formed so that the opening in the inner surface 32 of the diffuser resulting from their dismounting is of a width greater than the surface of the part 21*d* constituting a portion of the surface 33 of the diffuser.

Each of the parts 21*a* to 21*f* of the diffuser includes one or several tapped holes for the fixing of screws 30 enabling the lower portion of the diffuser to be connected to the suction pipe 22.

On the other hand, each of these parts of the diffuser is machined at its upper portion along a groove 36 of annular shape having for axis of symmetry of revolution, the axis of symmetry of the diffuser which is coincident with the axis yy' of the rotor when the diffuser and the rotor are in position in the volute 23 of the pump.

As is seen in FIG. 3, the groove 36 has a trapezoidal section one side of which is inclined towards the axis of the pump and upwardly.

Each of the parts of the diffuser includes on the other hand an annular projection 37 having also for axis of symmetry of revolution the axis of the diffuser or the axis yy' of the pump, when the diffuser is in position in the volute.

The upper wall of the volute 23 includes an annular groove 38 of axis yy'.

Finally, a centering part 40 including a part with a trapezoidal section 41 is constructed in the form of a ring of axis yy'. The annular part 40 is placed in position around the opening 25 on the volute 23, and fixed to this volute through screws 44 and corresponding to tapped holes 45 formed in the upper wall of the volute 23.

The groove 36 and the portion 41 of the centering part 40 have corresponding shapes, as is visible in FIG. 3.

The diffuser 21 can be manufactured by one-piece molding of the whole, then cutting up and machining this whole so as to obtain the different sections 21*a* to 21*f*. The diffuser could also be produced by separate manufacture of the various sections 21*a* to 21*f*.

The assembly operations of the diffuser inside the volute 23 will now be described in detail with reference to FIGS. 3 and 4.

During the assembly of the diffuser, the opening 25 is entirely unobstructed and the rotor 26 as well as the suction 22 have not yet been introduced into the volute. The centering part 40 is not yet in position on the upper part of this volute.

The various sections of the diffuser are introduced into the volute 23 through the opening 25 with an orientation permitting their passage through this opening 25.

These parts of the diffuser are introduced successively and their projections 27 are positioned in the groove 38, which assures the temporary holding of these different parts of the diffuser. Thus the parts 21*a*, 21*b*, 21*c*, 21*e* and 21*f* are positioned, and then the part 21*d* the outer surface of which is introduced into the space subsisting between the parts 21*c* and 21*e*. This part 21*d* occupies the position 21'*d* shown in dashed lines in FIG. 4. It then suffices to rotate this part 21*d* around the vertical axis passing through the point 0 seen in FIG. 4, by means of special tooling enabling the parts 21*d* to be grasped and to carry out the rotation, to pass the part from its position 21'*d* to its final position 21*d*.

The various groove portions 36 machined on the upper surfaces of the various parts of the diffuser 21 then constitute a continuous annular groove into which it is possible to introduce the portion 41 of the centering part 40 to effect the positioning and centering of the diffuser.

Screws 44 are then placed in position in the tapped holes 45 to effect the fastening of the part 40 and the final centering of the diffuser 21 in the volute. The suction pipe 22 is introduced into the central opening and its fastening to the volute assured.

The final fixing of the diffuser in the volute is then effected by the placing in position and tightening of the screws 30 connecting the lower portion of the diffuser 21 to the suction pipe 22.

The dismounting of the diffuser can obviously be carried out by the reverse operations.

Figure 5:
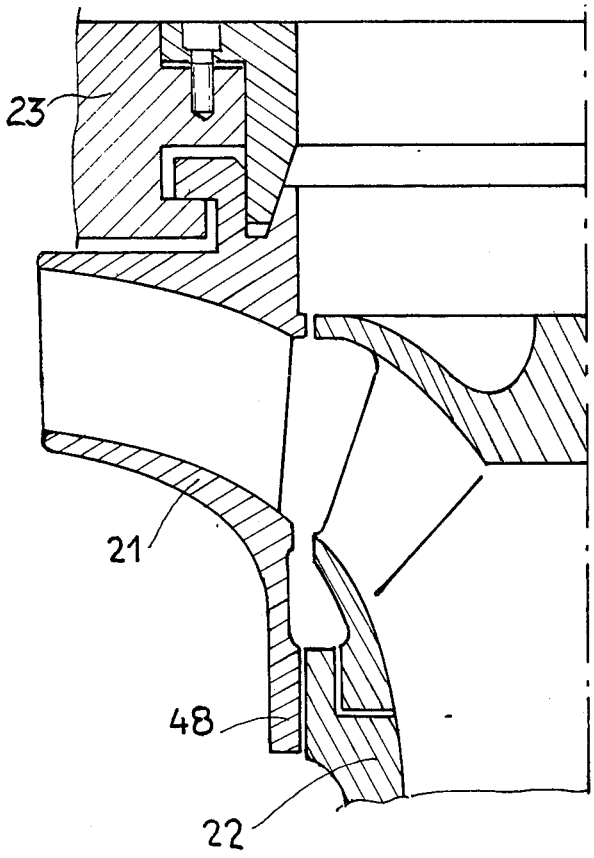
FIG. 5 is a drawing similar to that of FIG. 3, of a second embodiment of the fastening of the diffuser to the suction pipe of the pump.

FIG. 5 shows a modification of the fastening between the lower portion of the diffuser 21 and the upper portion of the suction pipe 22.

In this method of fastening, the lower portion 48 of the diffuser 21 is constituted by a cylindrical extension capping the upper portion of the suction pipe 22. It then suffices to carry out locking in rotation between the parts 21 and 22.

The principal advantages of the device according to the invention are to enable dismounting of the diffuser of the pump for examination of this diffuser and of the inner surface of the volute and of the welds, even if the upper axial opening of the pump is of small diameter.

On the other hand, the design proposed for the different portions of the diffuser facilitates its positioning inside the volute. The final positioning of these parts is carried out automatically on the postitioning of the centering part, which enables errors in assembly to be avoided.

However the invention is not limited to the embodiments which have been described; it includes on the contrary all modifications.

Thus the method of removably fixing the lower portion of the diffuser to the suction pipe may be of any type, and the cutting of the diffuser into portions enabling its dismounting is not limited to the embodiment which has been described.

On the other hand, the invention applies to any centrifugal pump whether of the radial diffuser type or of the axial diffuser type. The field of use of these pumps may obviously be quite different from that of circulating cooling fluid in a nuclear reactor.

What is claimed is:

1. Centrifugal pump with a dismountable diffuser for circulating a fluid, comprising (a) a volute constituted by an enclosure having openings for the entry and the exit of said fluid;

(b) a dismountable suction pipe fixed to said volute at the level of the entry opening for said fluid and directed towards the inside of the latter;

(c) a rotor placed inside said volute fixed to a shaft passing through an aperture provided in the wall of said volute and permitting the passage of said rotor, for joining said shaft to a drive motor as well as a diffuser of annular shape having for axis of symmetry of revolution the axis of rotation of said rotor, arranged around said rotor inside said volute and fixed to said suction pipe at one of its ends;

(d) said diffuser comprising at least three parts separable and couplable along coupling surfaces traversing the whole body of said diffuser between its inner surface located towards said rotor and its outer surface directed towards the inner surface of said volute and between its coupling end with said suction pipe provided with dismountable connecting means and its opposite end;

(e) each of said parts of said diffuser being machined along an annular groove portion with a trapezoidal section at its end opposite the end coupling with said suction pipe and including a projection forming a ring portion;

(f) said volute comprising an annular groove for the engagement of the annular projections of each of said parts of said diffuser, a centering part including an annular portion with a trapezoidal section being removably fixed to said volute for engagement in said annular groove with the trapezoidal section constituted by the groove portions of the diffuser parts, when they are juxtaposed for the mounting of the latter.

2. Centrifugal pump according to claim 1, wherein said dismountable connecting means between the end of said diffuser and said suction pipe are constituted by screws.

3. Centrifugal pump according to claim 1, wherein said dismountable connecting means between the end of said diffuser and said suction pipe are constituted by a cylindrical portion extending said diffuser and capping a corresponding cylindrical portion of said suction pipe.

4. Centrifugal pump according to claim 1, wherein the coupling surfaces between the different parts of said diffuser are curved surfaces situated with respect to said diffuser between two successive blades of the latter.

5. Centrifugal pump according to claim 4, wherein at least one of the parts of the diffuser has an outer surface directed towards the inner surface of said volute of width less than the width of the space left free between the two parts of said diffuser between which it is inserted, at the level of the inner surface of said diffuser directed towards said rotor.

6. Centrifugal pump according to any preceding claim, wherein said centering part of annular shape is fixed to said volute at the periphery of its axial aperture provided for the passage of said rotor.

* * * * *